US010221058B2

(12) United States Patent
Dresser et al.

(10) Patent No.: US 10,221,058 B2
(45) Date of Patent: Mar. 5, 2019

(54) MANEUVERABLE SERVICE DOOR FOR BEVERAGE DISPENSING MACHINES

(71) Applicant: Cornelius, Inc., St. Paul, MN (US)

(72) Inventors: Zachary Dresser, West Chicago, IL (US); Slawomir Kielian, Des Plaines, IL (US)

(73) Assignee: Cornelius, Inc., Osseo, MN (US)

( * ) Notice: Subject to any disclaimer, the term of this patent is extended or adjusted under 35 U.S.C. 154(b) by 253 days.

(21) Appl. No.: 14/964,819

(22) Filed: Dec. 10, 2015

(65) Prior Publication Data

US 2017/0101299 A1 Apr. 13, 2017

Related U.S. Application Data

(60) Provisional application No. 62/239,463, filed on Oct. 9, 2015.

(51) Int. Cl.
*B67D 1/00* (2006.01)
*B67D 1/06* (2006.01)
*B67D 1/08* (2006.01)

(52) U.S. Cl.
CPC ..... *B67D 1/06* (2013.01); *B67D 1/00* (2013.01); *B67D 1/0888* (2013.01); *B67D 1/0891* (2013.01); *B67D 2210/00041* (2013.01)

(58) Field of Classification Search
CPC ..... B67D 1/06; B67D 1/00; B67D 1/0888; B67D 1/0891; B67D 1/0021; Y10T 292/1039; Y10T 292/1041; E05Y 2900/20; E05Y 2900/31; E05Y 2900/132; E05Y 2900/609; E05Y 2900/00
(Continued)

(56) References Cited

U.S. PATENT DOCUMENTS 1,658,481 A * 2/1928 Ekman ..... E05C 3/145 292/241
1,836,917 A * 12/1931 Hammer ..... E05D 3/12 16/366

(Continued)

OTHER PUBLICATIONS

Pending U.S. Appl. No. 14/696,592, filed Apr. 27, 2015, Abrach et al., "Systems and Methods of Multi-Touch oncurrent Dispensing".

(Continued)

*Primary Examiner* — Charles P Cheyney
(74) *Attorney, Agent, or Firm* — Andrus Intellectual Property Law, LLP

(57) ABSTRACT

A beverage dispensing machine which defines a service opening through which beverage dispensing equipment is accessible to an operator includes a service door on a housing that is movable between an open position, such that the beverage dispensing equipment is accessible to an operator via the service opening, and a closed position, such that the service door closes the service opening so that the beverage dispensing equipment is inaccessible to the operator. A display panel on the service door displays operational characteristics of the beverage dispensing equipment. When the service door is in the open position the display panel is maneuverable so that the display panel is angled towards the service opening so that an operator can view the display panel while accessing the beverage dispensing equipment via the service opening.

14 Claims, 7 Drawing Sheets

(58) Field of Classification Search
USPC ..... 312/322, 325, 324, 319.2, 109; 222/23, 222/129.1, 145.6, 1, 144.5, 63, 325
See application file for complete search history.

(56) References Cited

U.S. PATENT DOCUMENTS 2,794,663 A * 6/1957 Grodt ..... E05C 3/167 292/148
4,174,872 A 11/1979 Fessler
5,594,620 A 1/1997 Register
5,881,917 A 3/1999 Jones et al.
6,006,243 A 12/1999 Karidis
6,182,555 B1 * 2/2001 Scheer ..... A47J 31/40 222/129.1
6,898,953 B1 * 5/2005 Paprocki ..... E05B 13/002 292/285
7,178,202 B2 * 2/2007 Hirtsiefer ..... E05D 3/14 16/286
7,240,974 B2 * 7/2007 Hirtsiefer ..... E05D 15/262 312/109
7,337,920 B2 * 3/2008 Duck ..... B67D 1/0878 222/129.4
7,404,233 B2 7/2008 Lu et al.
7,551,426 B2 6/2009 Huang et al.
7,652,873 B2 1/2010 Lee
7,665,775 B1 2/2010 Miller et al.
8,308,205 B2 * 11/2012 Tejszerski ..... E05B 65/0007 292/230
8,602,263 B2 * 12/2013 Baron ..... B67D 1/0079 222/129.1
8,690,016 B2 4/2014 Anderson et al.
8,776,838 B1 7/2014 Dorney
8,893,926 B2 11/2014 Anderson et al.
8,904,709 B2 * 12/2014 Ajiki ..... E05C 17/32 312/319.2
8,905,267 B2 12/2014 Minard et al.
9,086,853 B2 7/2015 Hu
2008/0276551 A1 11/2008 Thomas et al.
2010/0018406 A1 * 1/2010 Koopman ..... A47J 31/401 99/300
2012/0194977 A1 8/2012 Liu et al.
2013/0021723 A1 1/2013 Harper et al.
2014/0188271 A1 7/2014 Hernandez et al.
2015/0096694 A1 4/2015 Bonetti
2016/0185587 A1 * 6/2016 Fukushima ..... B67D 1/0888 222/23

OTHER PUBLICATIONS

International Search Report and Written Opinion PCT/US2016/047516 dated Nov. 4, 2016.

* cited by examiner

MANEUVERABLE SERVICE DOOR FOR BEVERAGE DISPENSING MACHINES

CROSS-REFERENCE TO RELATED APPLICATION

The present application claims priority U.S. Provisional Patent Application No. 62/239,463, filed on Oct. 9, 2015, the content of which is hereby incorporated herein by reference in its entirety.

FIELD

The present disclosure relates to apparatuses for beverage dispensing machines, specifically maneuverable service doors for beverage dispensing machines.

BACKGROUND

The following U.S. patents and patent application are incorporated herein by reference in entirety: U.S. Pat. Nos. 8,690,016, 8,893,926, and U.S. patent application Ser. No. 14/696,592 (filed Apr. 27, 2015).

SUMMARY

This Summary is provided to introduce a selection of concepts that are further described herein below in the Detailed Description. This Summary is not intended to identify key or central features from the claimed subject matter, nor is it intended to be used as an aid in limiting the scope of the claimed subject matter.

In certain examples, a beverage dispensing machine includes a housing that houses beverage dispensing equipment for the beverage dispensing machine. The housing defines a service opening through which the beverage dispensing equipment is accessible to an operator. The beverage dispensing machine includes a service door on the housing that is movable between an open position such that the beverage dispensing equipment is accessible to an operator via the service opening and a closed position such that the service door closes the service opening so that the beverage dispensing equipment is inaccessible to the operator. The service door has an inner side that faces the housing when the service door is in the closed position and the service door has an outer side that faces away from the housing when the service door is in the closed position. A display panel on the outer side of the service door is configured to display an operational characteristic of the beverage dispensing equipment to an operator when the service door is in the closed position and when the service door is in the open position. When the service door is in the open position the display panel is maneuverable so that the display panel is angled towards the service opening so that an operator can view the display panel while accessing the beverage dispensing equipment via the service opening.

In certain examples, a door apparatus for a beverage dispense machine having a housing for housing beverage dispensing equipment of the beverage dispensing machine and defining a service opening through which the beverage dispensing equipment is accessible to an operator includes a service door coupled to the housing and movable between an open position such that the beverage dispensing equipment is accessible to an operator via the service opening and a closed position such that the service door closes the service opening so that the beverage dispensing equipment is inaccessible to the operator. The service door has an inner side that faces the housing when the service door is in the closed position and an outer side that faces away from the housing when the service door is in the closed position. A display panel on the outer side of the service door is configured to display an operational characteristic of the beverage dispensing equipment to an operator when the service door is in the closed position and when the service door is in the open position. When the service door is in the open position the display panel is maneuverable such that the display panel is angled towards the service opening so that an operator can view the display panel while accessing the beverage dispensing equipment via the service opening.

BRIEF DESCRIPTION OF THE DRAWINGS

Examples of a beverage dispensing machine are described with reference to the following drawing FIGURES. The same numbers are used throughout the FIGURES to reference like features and components.

DETAILED DESCRIPTION OF THE DRAWINGS

Figure 1:
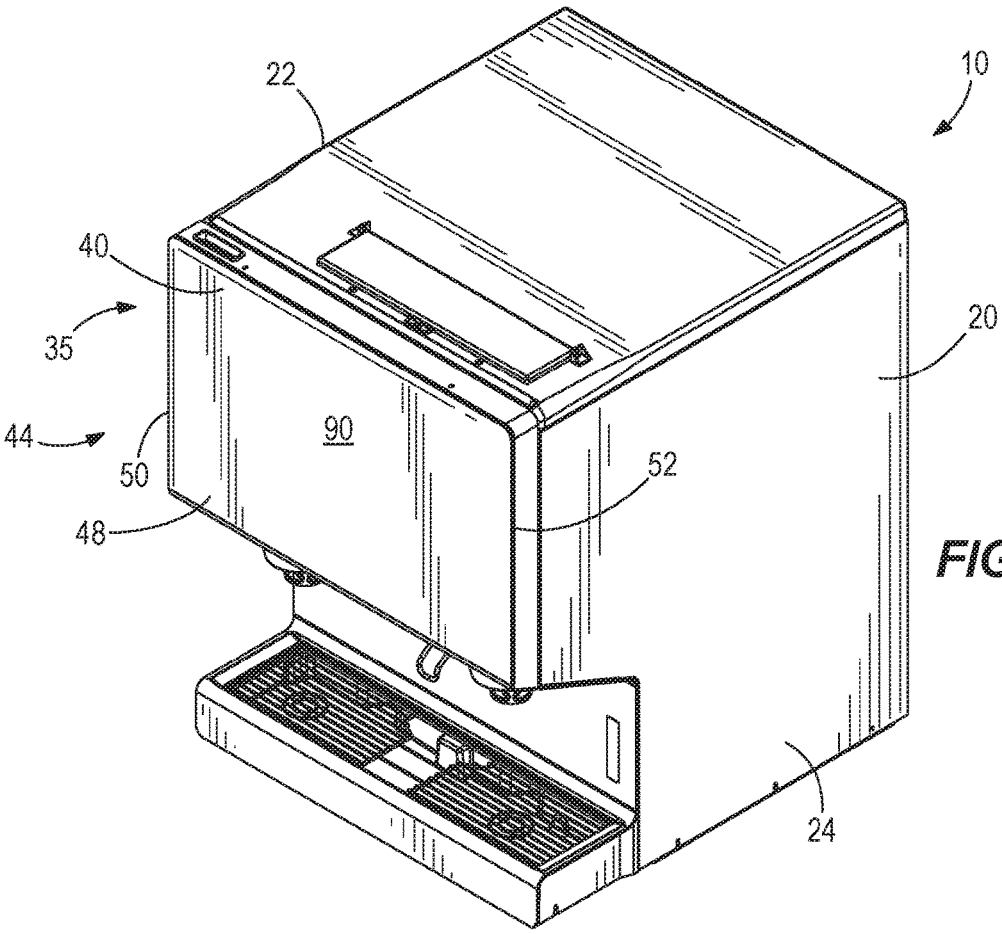
FIG. 1 is a perspective view of a beverage dispensing machine having a service door in a closed position.
Figure 2:
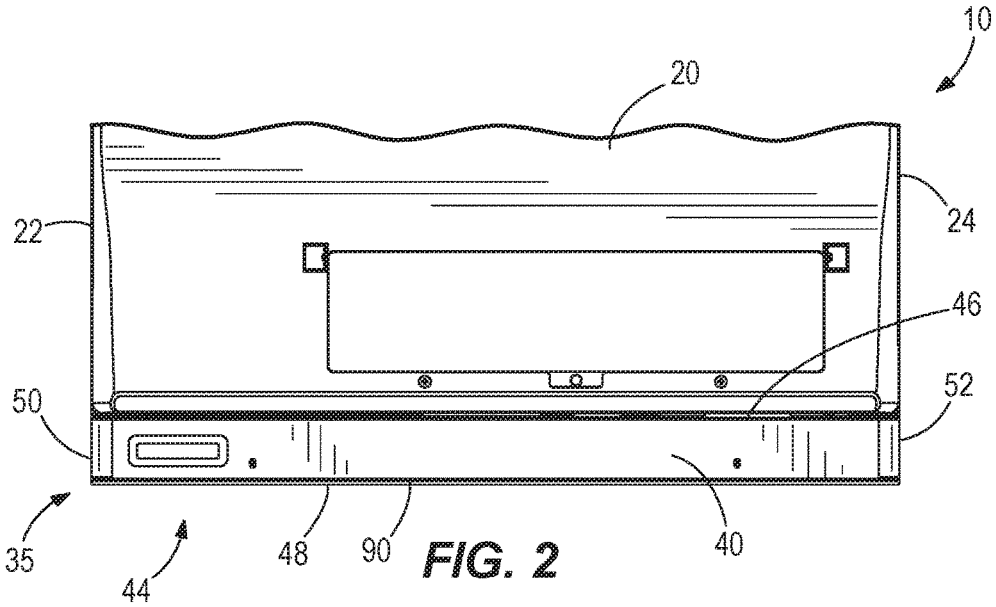
FIG. 2 is a top view of FIG. 1.
Figure 3:
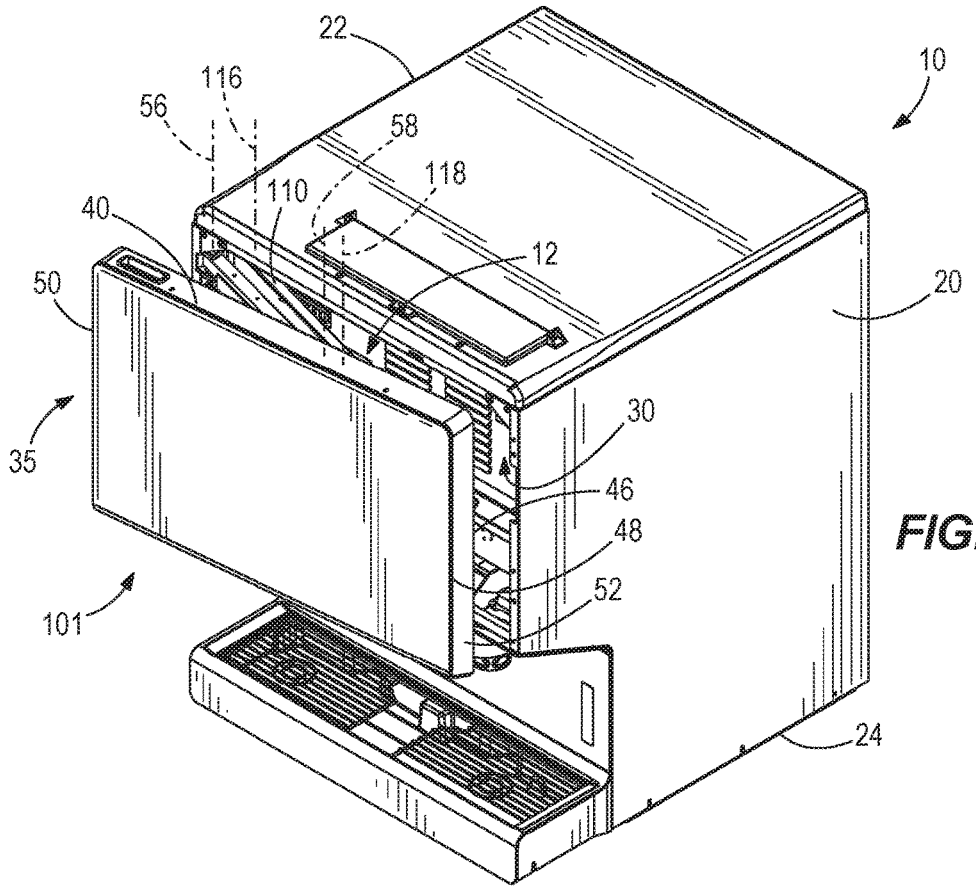
FIG. 3 is a perspective view of the service door in a first intermediate position.
Figure 4:
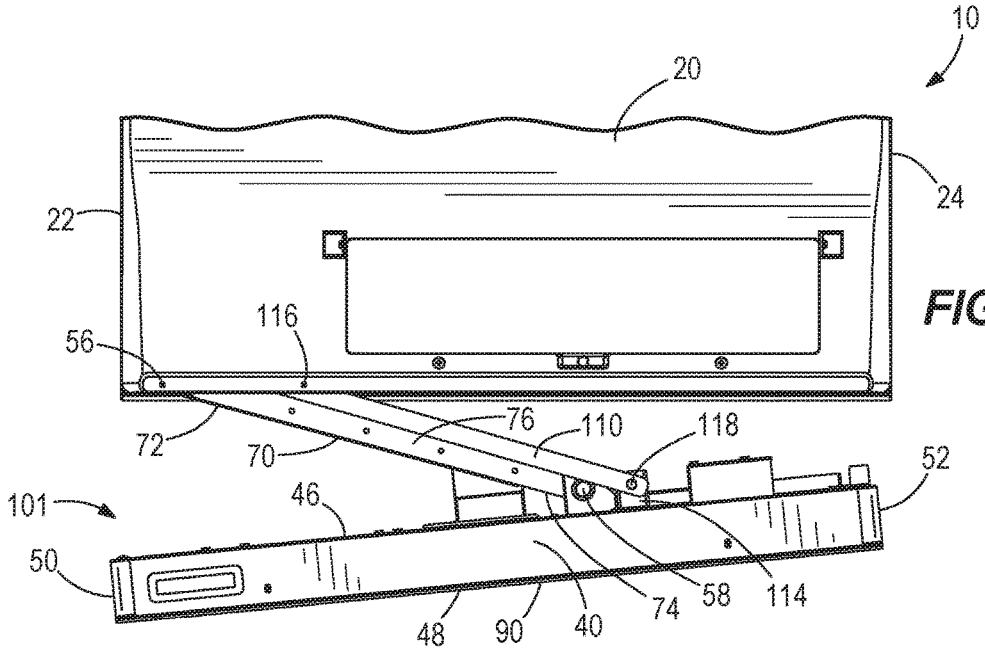
FIG. 4 is a top view of FIG. 3.
Figure 5:
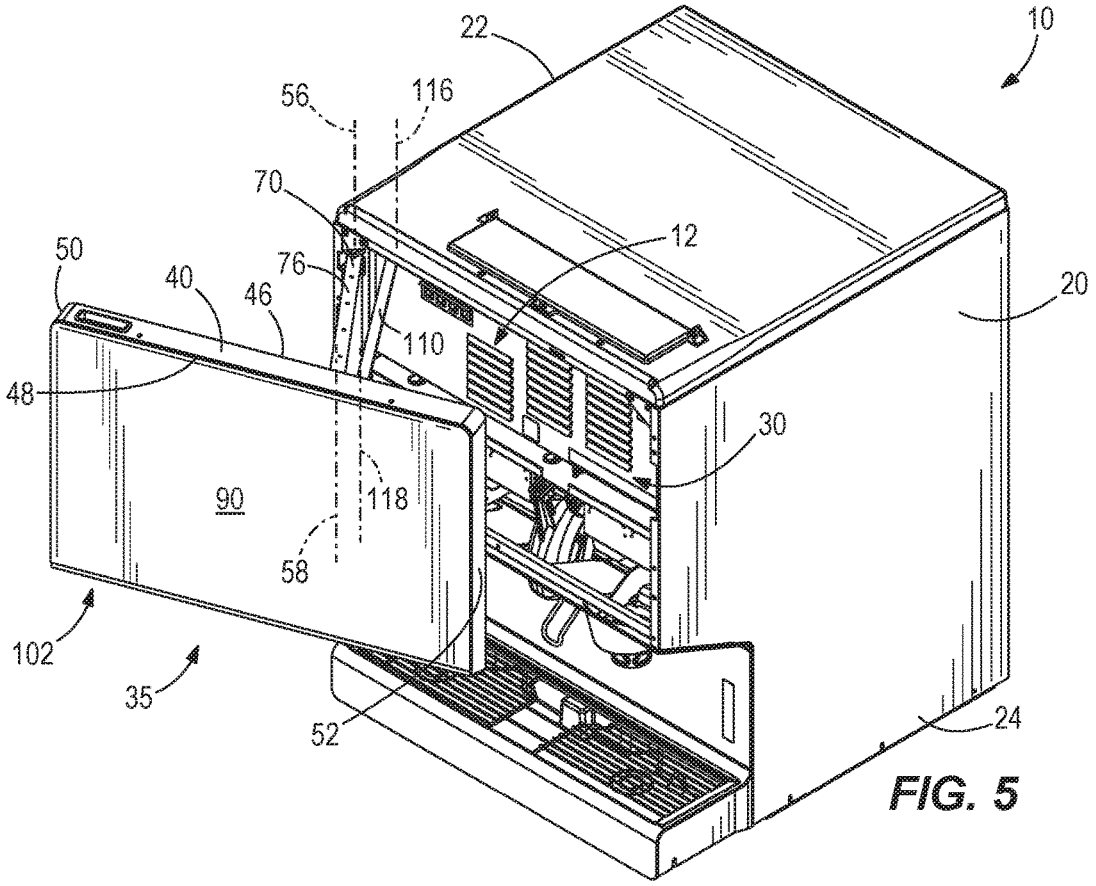
FIG. 5 is a perspective view of the service door in a second intermediate position.
Figure 6:
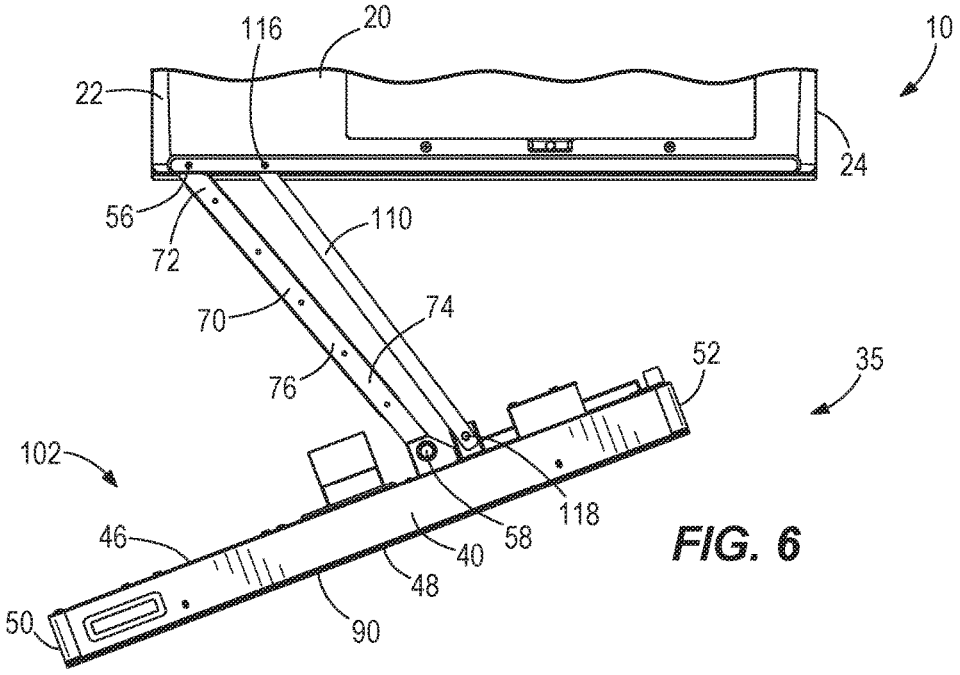
FIG. 6 is a top view of FIG. 5.

FIGS. 1-12 depict an example beverage dispensing machine 10 that includes a doors apparatus 35 configured to allow an operator to view a display panel 90 while working on beverage dispensing equipment 12 enclosed by a housing 20. The beverage dispensing equipment 12 (see FIG. 7) is accessible to an operator though a service opening 30 after the door apparatus 35 is maneuvered away from the service opening 30.

Figure 7:
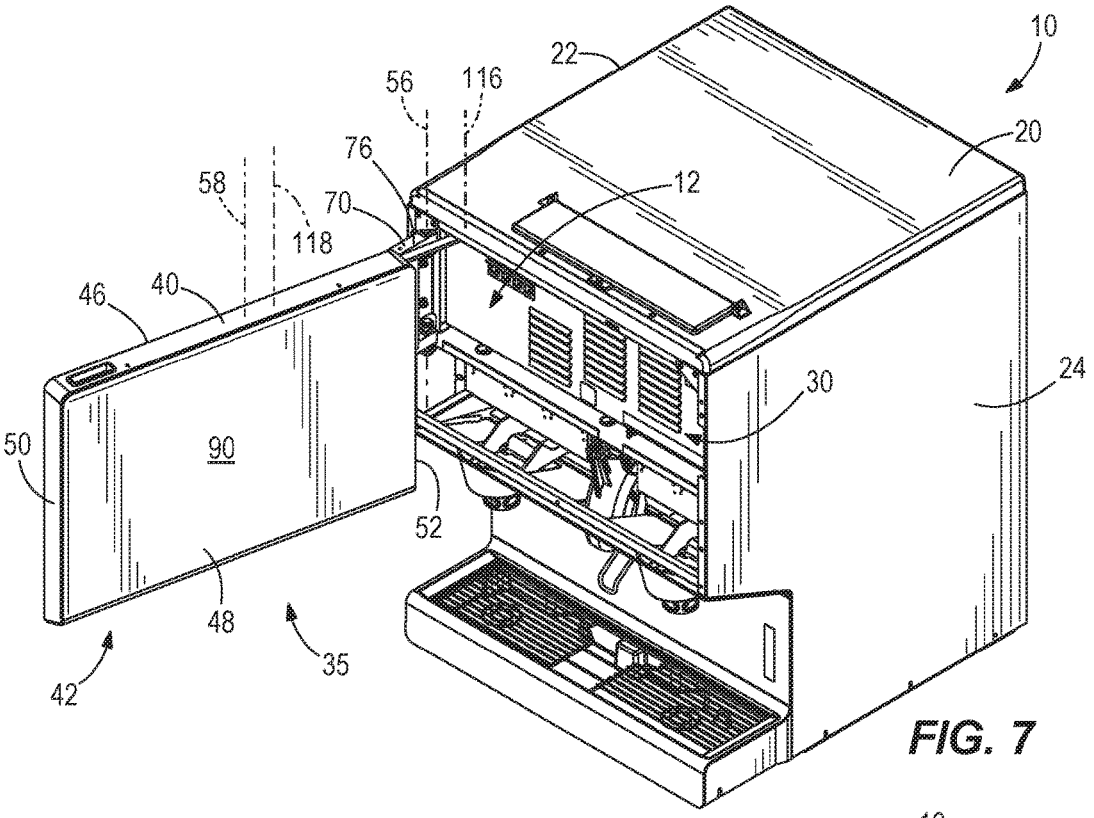
FIG. 7 is a perspective view of the service door in an open position.
Figure 8:
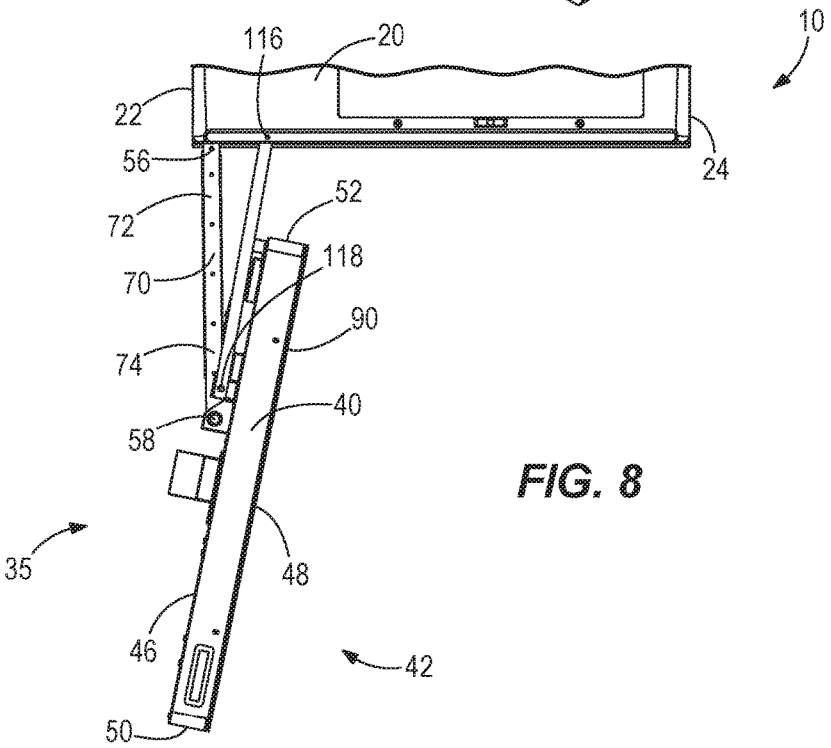
FIG. 8 is a top view of FIG. 7.

The housing 20 houses the beverage dispensing equipment 12 for the beverage dispensing machine 10 and defines the service opening 30 through which the beverage dispensing equipment 12 is accessible to an operator (see FIG. 7). The housing 20 has a left side 22 and a right side 24 that are on opposite sides of the service opening 30.

The door apparatus 35 is coupled to the housing 20 and includes a service door 40 and the display panel 90. The service door 40 is movable between an open position 42 (see FIGS. 7 and 8) wherein the beverage dispensing equipment 12 is accessible to an operator via the service opening 30 and a closed position 44 (see FIGS. 1 and 2) wherein the service door 40 closes the service opening 30 so that the beverage dispensing equipment 12 is inaccessible to the operator. As the service door 40 is moved between the open position 42 and the closed position 44, the service door 40 can move into intermediate positions between the open position 42 and the closed position 44 such as a first intermediate position 101 (see FIGS. 3 and 4) and a second intermediate position 102 (see FIGS. 5 and 6). The service door 40 has a left side 50, a right side 52, an inner side 46 that faces the housing 20 when the service door 40 is in the closed position 44, and an outer side 48 that faces away from the housing 20 when the service door 40 is in the closed position 44 (see FIG. 2). The display panel 90 is coupled to the outer side 48 of the service door 40 and is configured to display an operational characteristic of the beverage dispensing equipment 12 to the operator when the service door 40 is in the closed position or open position. The display panel 90 can display any type of operational characteristic such as operating status, maintenance instructions, and/or the like via any suitable type of device such as a video board, a LCD screen, a touch screen, a graphic picture, and/or the like.

When the service door 40 is in the open position 42 the display panel 90 is maneuverable so that the display panel 90 is angled towards the service opening 30. (see FIG. 7). In this position, the operator can view the display panel 90 while accessing the beverage dispensing equipment 12 via the service opening 30. In some examples, the both the service door 40 and the display panel 90 are maneuverable and/or pivotable so that the display panel 90 is angled towards the service opening 30. The service door 40 pivots about a first pivot axis 56 between the open position 42 and the closed position 44. (see FIGS. 3 and 5) When the service door 40 is in the open position 42 (see FIG. 7), the service door 40 and display panel 90 are pivotable about a second pivot axis 58 so that the display panel 90 is angled towards the service opening 30.

Figure 9:
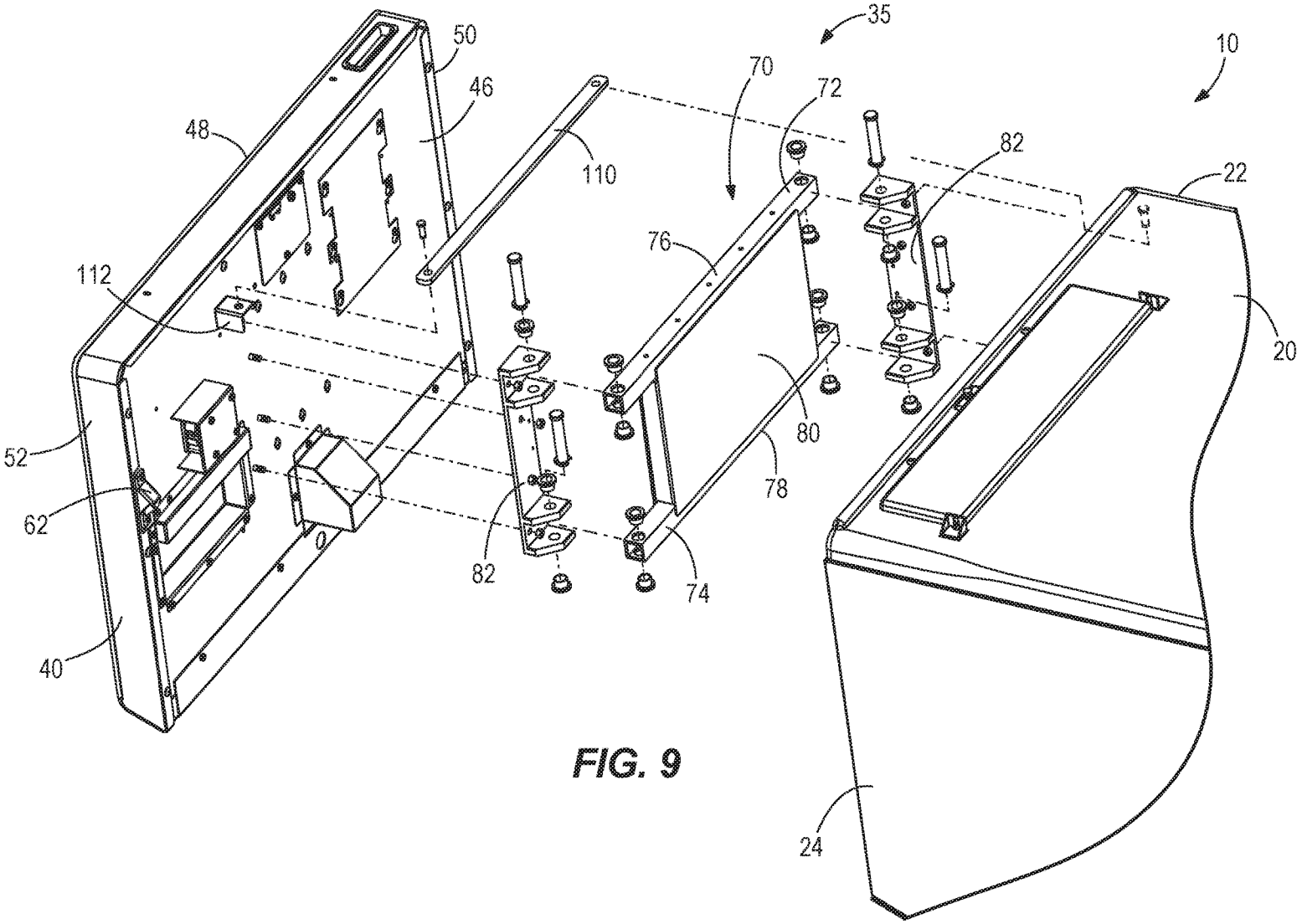
FIG. 9 is an exploded view of a pivot arm.

Referring to FIG. 9, the door apparatus 35 includes a pivot arm 70 which couples the service door 40 to the housing 20. (see FIGS. 4 and 6). The pivot arm 70 includes a first end 72 that is coupled to the housing 20 at the first pivot axis 56 and a second end 74 that is coupled the service door 40 at the second pivot axis 58. In some examples, the pivot arm 70 is coupled to the left or right side 22, 24 of the housing 20 so that pivoting of the service door 40 about the first pivot axis 56 from the open position 42 to the closed position 44 completely closes the service opening 30. The pivot arm 70 is coupled to the service door 40 between the left and right sides 50, 52 so that the second pivot axis 58 located between the left and right sides 50, 52.

In the illustrated example, the pivot arm 70 includes an upper support member 76 and a lower support member 78 that each extend between the first and second pivot axes 56, 58. A vertical support plate 80 extends between the upper support member 76 and the lower support member 78, and vertical pivot brackets 82 couple the upper and lower support members 76, 78 to the housing 20 and the service door 40, respectively.

Figure 11:
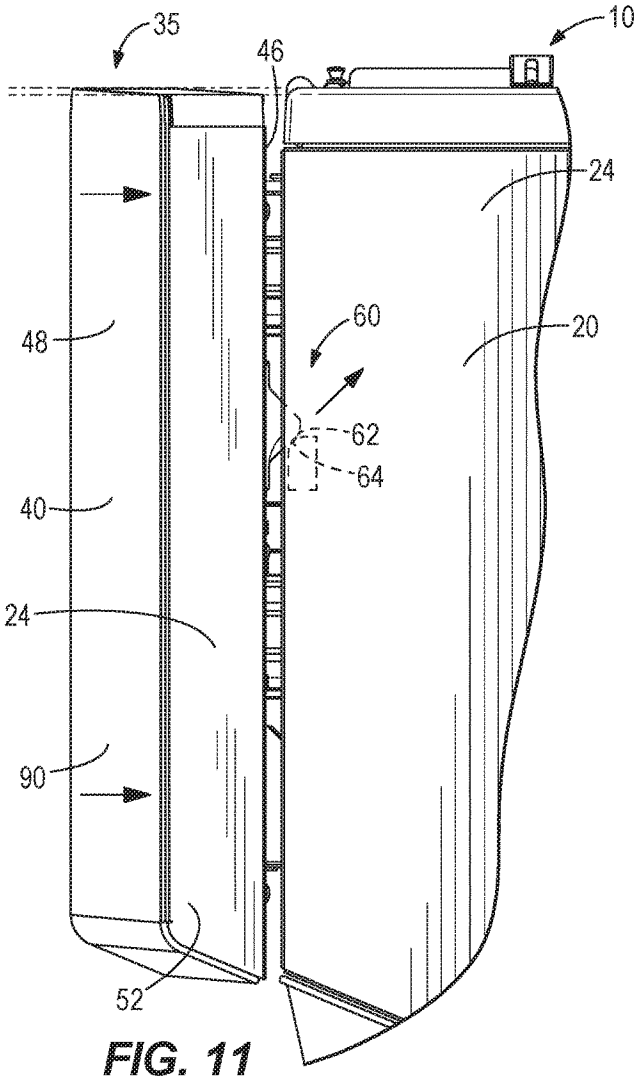
FIG. 11 is a side view of the service door moving toward the housing and a first camming surface and a second camming surface contacting each other.
Figure 10:
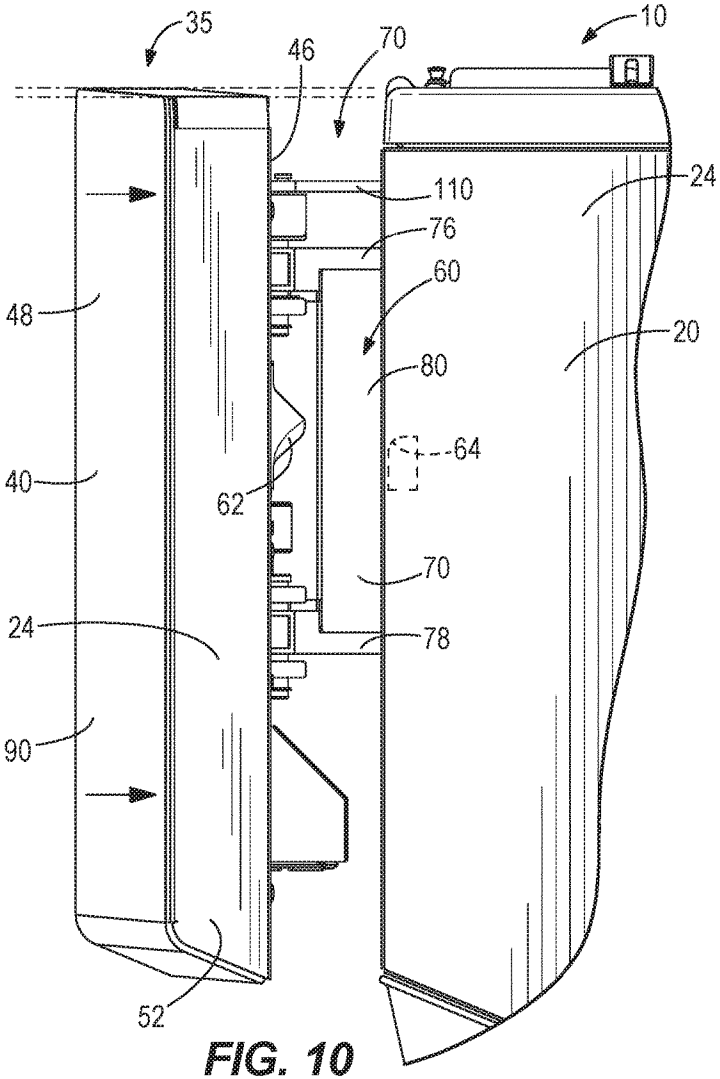
FIG. 10 is a side view of the service door moving toward a housing.
Figure 12:
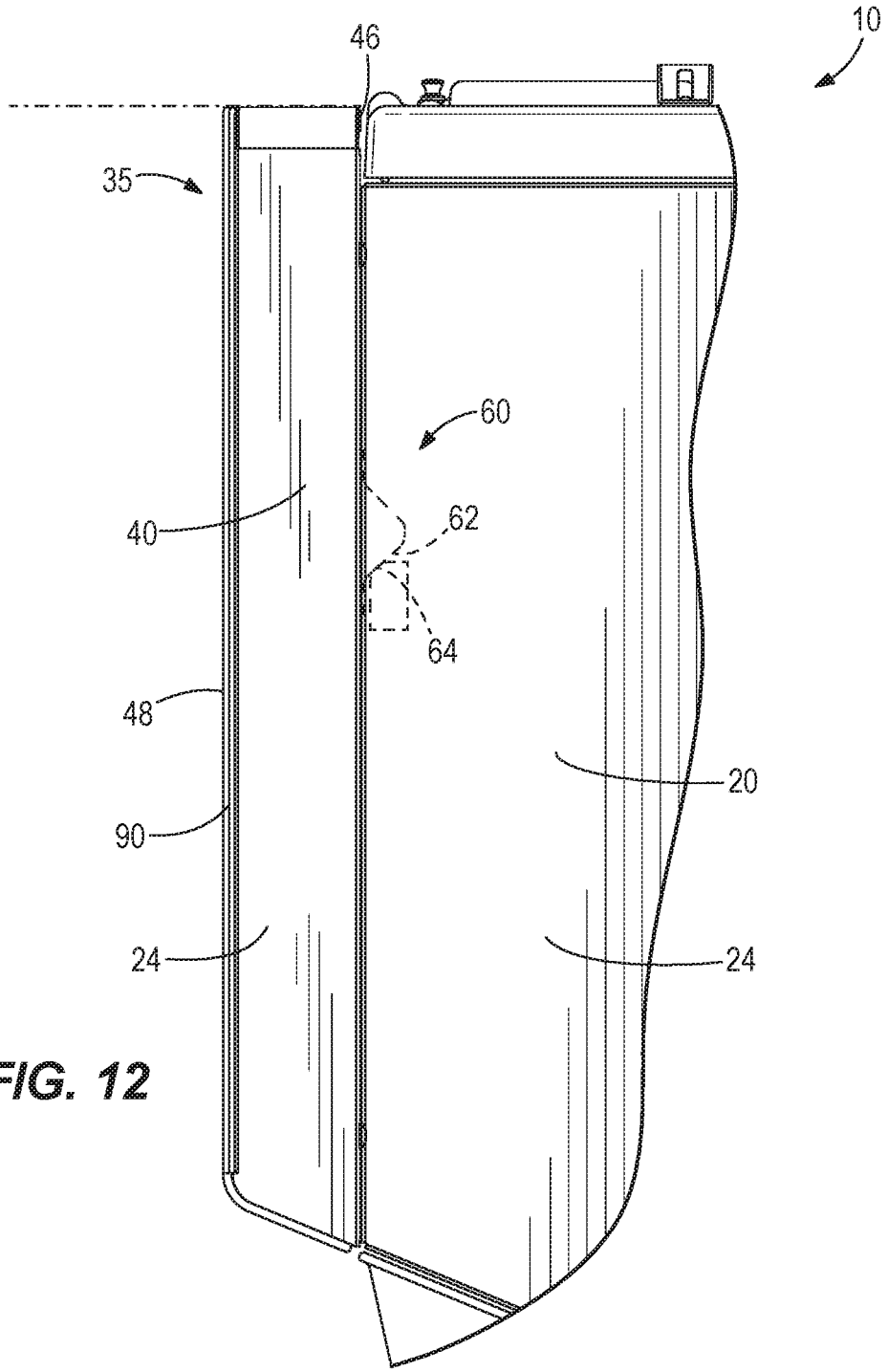
FIG. 12 is a side view of the service door in the closed position.

Referring to FIGS. 10-12, a latch 60 latches the service door 40 into the closed position 44. The latch 60 is configured to align the service door 40 with the service opening 30 such that the service door 40 aligns with and closes the service opening 30 despite sag occurring in the pivot arm 70 due to the weight of the door apparatus 35. The latch 60 includes a first camming surface 62 on the service door 40 and a second camming surface 64 on the housing 20 (the second camming surface 64 is depicted in dashed lines; the second camming surface 64 in the example depicted by FIGS. 10-12 is on the inside surface of the housing 20). The first camming surface 62 and second camming surface 64 are curved. When the service door 40 is moved from the open position 42 towards the closed position 44, the first camming surface 62 is cammed upwardly by the second camming surface 64 to squarely align the service door 40 with the service opening 30.

Referring to FIGS. 4, 6, and 8-9, a guide bar 110 pivotally couples the door apparatus 35 to the housing 20. The guide bar 110 is coupled to the inner side 46 of the service door 40 by a first guide bracket 112 at a fourth pivot axis 118 and the housing 20 by a second guide bracket (not shown) at a third pivot axis 116. The guide bar 110 controls the rotation of the service door 40 and the display panel 90 about the first pivot axis 56 and the second pivot axis 58 as the service door 40 and the display panel 90 move between the open position 42 and the closed position 44. The third pivot axis 116 is offset and parallel to the first pivot axis 56 adjacent to the housing 20, and the fourth pivot axis 118 is offset and parallel to second pivot axis 58 along the inner surface 46 of the service door 40. The guide bar 110 can be disconnected the door apparatus 35 and/or the housing 20 to allow the door apparatus 35 to freely rotate.

In the present description, certain terms have been used for brevity, clearness and understanding. No unnecessary imitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A beverage dispensing machine comprising:

a housing that houses beverage dispensing equipment for the beverage dispensing machine, wherein the housing defines a service opening through which the beverage dispensing equipment is accessible to an operator;

a service door on the housing, the service door being movable between an open position wherein the beverage dispensing equipment is accessible to an operator via the service opening and a closed position wherein the service door closes the service opening so that the beverage dispensing equipment is inaccessible to the operator;

wherein the service door has an inner side that faces the housing when the service door is in the closed position and wherein the service door has an outer side that faces away from the housing when the service door is in the closed position;

a display panel on the outer side of the service door, wherein the display panel is configured to display an operational characteristic of the beverage dispensing equipment to an operator when the service door is in the closed position and when the service door is in the open position, wherein when the service door is in the open position the display panel is maneuverable so that the display panel is angled towards the service opening so that an operator can view the display panel while accessing the beverage dispensing equipment via the service opening;

a pivot arm that couples the service door to the housing, wherein the pivot arm has a first end that is coupled to the housing at a first pivot axis and a second end that is coupled to the service door at a second pivot axis, the pivot arm further includes a pair of support members that are vertically spaced apart from each other and a support plate that extends between the pair of support members, each support member of the pair of support members has a first end at the first pivot axis and an opposite, second end at the second pivot axis and; and a latch that latches the service door into the closed position, wherein the latch is configured to vertically align the service door with the service opening such that the service door squarely aligns with and closes the service opening despite sag due to gravity occurring in the pivot arm;

wherein the latch comprises a first camming surface that is fixedly coupled to the service door and a second camming surface that is fixedly coupled to the housing, and wherein the first camming surface remains stationary with respect to the service door and the second camming surface remains stationary with respect to the housing as the first camming surface and the service door are upwardly cammed by the second camming surface so as to align the service door with the service opening.

2. The beverage dispensing machine according to claim 1, wherein in the open position both the service door and the display panel are maneuverable so that the display panel is angled towards the service opening.

3. The beverage dispensing machine according to claim 1, wherein in the open position both the service door and the display panel are pivotable so that the display panel is angled towards the service opening.

4. The beverage dispensing machine according to claim 1, wherein the first and second camming surfaces are curved.

5. A door apparatus for a beverage dispense machine having a housing that houses beverage dispensing equipment for the beverage dispensing machine, wherein the housing defines a service opening through which the beverage dispensing equipment is accessible to an operator, the door apparatus comprising:

a service door for the housing, the service door being movable between an open position wherein the beverage dispensing equipment is accessible to an operator via the service opening and a closed position wherein the service door closes the service opening so that the beverage dispensing equipment is inaccessible to the operator;

wherein the service door has an inner side that faces the housing when the service door is in the closed position and wherein the service door has an outer side that faces away from the housing when the service door is in the closed position;

a display panel on the outer side of the service door, wherein the display panel is configured to display an operational characteristic of the beverage dispensing equipment to an operator when the service door is in the closed position and when the service door is in the open position, wherein when the service door is in the open position the display panel is maneuverable so that the display panel is angled towards the service opening so that an operator can view the display panel while accessing the beverage dispensing equipment via the service opening;

a pivot arm that couples the service door to the housing, wherein the pivot arm has a first end that is coupled to the housing at a first pivot axis and a second end that is coupled to the service door at a second pivot axis, the pivot arm further includes a pair of support members that are vertically spaced apart from each other and a support plate that extends between the pair of support members, each support member of the pair of support members has a first end at the first pivot axis and an opposite, second end at the second pivot axis; and a latch that latches the service door into the closed position, wherein the latch is configured to vertically align the service door with the service opening such that the service door squarely aligns with and closes the service opening despite sag due to gravity occurring in the pivot arm;

wherein the latch comprises a first camming surface that is fixedly coupled to the service door and a second camming surface that is fixedly coupled to the housing, and wherein when the service door is moved into the closed position, the first camming surface remains stationary with respect to the service door and the second camming surface remains stationary with respect to the housing.

6. The door apparatus according to claim 3, wherein in the open position both the service door and the display panel are maneuverable so that the display panel is angled towards the service opening.

7. The door apparatus according to claim 3, wherein in the open position both the service door and the display panel are pivotable so that the display panel is angled towards the service opening.

8. The door apparatus according to claim 5, wherein the first and second camming surfaces are curved.

9. A beverage dispensing machine comprising:

a housing that houses beverage dispensing equipment for the beverage dispensing machine, wherein the housing defines a service opening through which the beverage dispensing equipment is accessible to an operator;

a service door on the housing, the service door being movable between an open position wherein the beverage dispensing equipment is accessible to an operator via the service opening and a closed position wherein the service door closes the service opening so that the beverage dispensing equipment is inaccessible to the operator, wherein the service door has an inner side that faces the housing when the service door is in the closed position and wherein the service door has an outer side that faces away from the housing when the service door is in the closed position;

a display panel on the outer side of the service door, wherein the display panel is configured to display an operational characteristic of the beverage dispensing equipment to an operator when the service door is in the closed position and when the service door is in the open position, wherein when the service door is in the open position the display panel is maneuverable so that the display panel is angled towards the service opening so that an operator can view the display panel while accessing the beverage dispensing equipment via the service opening;

a pivot arm extending between a first end that couples to the housing at a first pivot axis and a second end that couples to the service door at a second pivot axis and including a pair of support members that are vertically spaced apart from each other and a support plate that extends between the pair of support members, each support member of the pair of support members has a first end at the first pivot axis and an opposite, second end at the second pivot axis; and a guide bar coupled to the housing and the service door and configured to control pivoting of the service door about the first pivot axis and the second pivot axis; and wherein the guide bar is coupled to the housing at a third pivot axis and to the service door at a fourth pivot axis, wherein the first pivot axis is parallel and offset form the third pivot axis and wherein the second pivot axis is parallel and offset from the fourth pivot axis;

a latch that latches the service door into the closed position, wherein the latch is configured to vertically align the service door with the service opening such that the service door squarely aligns with and closes the service opening despite sag due to gravity occurring in the pivot arm;

wherein the latch comprises a first camming surface that is fixedly coupled to the service door and a second camming surface that is fixedly coupled to the housing, and wherein the first camming surface remains stationary with respect to the service door and the second camming surface remains stationary with respect to the housing as the first camming surface and the service door are upwardly cammed by the second camming surface so as to align the service door with the service opening.

10. The beverage dispensing machine according to claim 9, wherein the guide bar is configured to be disconnected from the housing or service door such that the service door freely pivots.

11. The beverage dispensing machine according to claim 9, wherein the guide bar extends transverse to the pivot arm when the service door is in the open position.

12. The beverage dispensing machine according to claim 9, wherein guide bar and the pivot arm define an angle when the service door is in the open position, and wherein the angle decreases as the service door is moved toward the closed position.

13. The beverage dispensing machine according to claim 9, wherein the guide bar is vertically directly disposed above the pivot arm when the service door is in the closed position.

14. The beverage dispensing machine according to claim 13, wherein the guide bar and pivot arm are fully enclosed in the housing when the service door is in the closed position.

* * * * *